US010154943B1

(12) United States Patent
Bernkrant et al.

(10) Patent No.: US 10,154,943 B1
(45) Date of Patent: Dec. 18, 2018

(54) APPARATUS FOR SEQUENTIAL DISPENSING

(71) Applicant: European American Armory Corporation, Cocoa, FL (US)

(72) Inventors: Keith David Bernkrant, Cocoa, FL (US); Paul Scott Richter, Titusville, FL (US)

(73) Assignee: European America Armory Corp.

( * ) Notice: Subject to any disclaimer, the term of this patent is extended or adjusted under 35 U.S.C. 154(b) by 0 days.

(21) Appl. No.: 15/971,652

(22) Filed: May 4, 2018

(51) Int. Cl.

| | |
|---|---|
| ***B65D 75/00*** | (2006.01) |
| ***A61J 7/04*** | (2006.01) |
| ***A61J 7/00*** | (2006.01) |
| ***A61J 1/03*** | (2006.01) |

(52) U.S. Cl.
CPC . *A61J 7/04* (2013.01); *A61J 1/03* (2013.01); *A61J 7/0084* (2013.01)

(58) Field of Classification Search
USPC ..... 206/37, 38, 528, 538, 534.1
See application file for complete search history.

(56) References Cited

U.S. PATENT DOCUMENTS

| | | | | |
|---|---|---|---|---|
| 2009/0078606 | A1* | 3/2009 | Conley | A61J 7/0472 206/534 |
| 2009/0283437 | A1* | 11/2009 | Angelucci | A61J 7/04 206/530 |
| 2010/0147735 | A1* | 6/2010 | Musgray | A61J 1/03 206/538 |
| 2015/0257980 | A1* | 9/2015 | Fung | A61J 1/03 700/242 |
| 2016/0074283 | A1* | 3/2016 | Aggarwal | A61J 7/04 206/534 |

* cited by examiner

*Primary Examiner* — Jacob K Ackun
(74) *Attorney, Agent, or Firm* — Daniel C. Pierron; Widerman Malek, PL

(57) ABSTRACT

A dispensing apparatus comprising a housing comprising a plurality of inner walls that define a plurality of cells, and a plurality of covers, each cover comprising a cover member and an extension member extending downwards from the cover member. Each cell may permit an object to be positioned there within. The plurality of inner walls may suspend the plurality of covers, thereby preventing access to a cell of the plurality of cells. The plurality of inner walls facilitates the transitioning of covers from one cell to an adjacent cell. The extension members interface with an object positioned a cell, such that the object prevents the transition of a cover from an adjacent cell to the cell and the absence of an object within the cell enables the transition of a cover of the plurality of covers from an adjacent cell to the cell, providing access to the adjacent cell.

20 Claims, 4 Drawing Sheets

APPARATUS FOR SEQUENTIAL DISPENSING

FIELD OF THE INVENTION

The present invention relates to apparatuses for sequential dispensing of objects.

BACKGROUND

Apparatuses for dispensing of small objects, such as medication, are widely known. Such apparatuses have typically facilitated easy access to objects that, while providing an indication of a desired sequence of retrieving the objects (such as indicating a day of the week, time of day, etc.), have not provided any method of requiring a person to remove a first object in a desired sequence prior to gaining access to a second access in the desired sequence. As such, the person may inadvertently obtain the objects out of sequence, resulting in potentially drastic consequences. Accordingly, there is a need in the art for an apparatus that may require the person to acquire objects in a desired sequence.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to dispensing apparatus including a housing including a plurality of inner walls, the plurality of inner walls defining a plurality of cells. The dispensing apparatus may also include a plurality of covers, each cover including a cover member and an extension member extending downwards from the cover member. The dispensing apparatus may also include where each cell of the plurality of cells is operable to permit medication to be positioned there within. Additionally, the plurality of inner walls may be configured to interface with and suspend the cover members of the plurality of covers, such that each cover may prevent access to a cell of the plurality of cells. Furthermore, the plurality of inner walls may be configured to facilitate the transitioning of the plurality of covers from an instant cell to an adjacent cell of the plurality of cells in one direction and to prevent transition to an adjacent cell in another direction. The covers of the plurality of covers may be configured to prevent two covers of the plurality of covers from being positioned so as to simultaneously prevent access to a single cell of the plurality of cells. The extension members may be operable to interface with an object positioned within the plurality of cells, such that the presence of an object within an instant cell prevents the transition of a cover of the plurality of covers from an adjacent cell to the instant cell and the absence of an object within the instant cell enables the transition of a cover of the plurality of covers from an adjacent cell to the instant cell, thereby providing access to the adjacent cell.

Implementations may include one or more of the following features. The plurality of covers may include a number of covers that is one fewer than the number of cells included by the plurality of cells. Additionally, the plurality of inner walls may be configured to permit each cover of the plurality of covers to transition exclusively between two cells of the plurality of cells. The plurality of inner walls may be configured to permit a first cover of the plurality of covers to transition exclusively between first and second cells of the plurality of cells. The plurality of inner walls may be configured to permit a second cover of the plurality of covers to transition exclusively between second and third cells of the plurality of cells. The second cover may be able to transition from the third cell to the second cell only when the first cover is positioned at the first cell.

In some embodiments the apparatus may further include a frame configured to be attached to the housing and to prevent detachment of the covers from the apparatus. The frame may define a plurality of frame apertures and the plurality of cells may be accessible through the plurality of frame apertures.

In some embodiments, each extending member of the plurality of covers may be configured to interface with an object positioned within an instant cell of the plurality of cells thereby preventing the transitioning of a cover from an adjacent cell to the instant cell. Furthermore, the plurality of inner walls may be configured to inhibit the transitioning of an object from one cell to an adjacent cell. Additionally, the plurality of inner walls may define a plurality of inner walls apertures configured to facilitate the positioning there within and transition there through of extension members of the plurality of covers. The positioning of an extension member within an inner wall aperture may prevent the transitioning of objects between adjacent cells.

In some embodiments the apparatus may further include a plurality of inserts configured to permit objects to be positioned there within. The plurality of inner walls is configured to permit an insert of the plurality of inserts within each cell of the plurality of cells. Each insert of the plurality of inserts may be configured to be removed from the plurality of cells; and where the extension member of each cover of the plurality of covers is configured to interface an insert positioned within a cell, thereby preventing the transition of a cover of the plurality of covers from an adjacent cell to an instant cell containing an insert. The plurality of inner walls may be configured to prevent inserts from transitioning between adjacent cells.

In some embodiments, the apparatus may further include a controller and a plurality of sensors positioned in communication with the controller operable to detect when an extension member transitions from one cell to another. The apparatus may also include an alerting device positioned in communication with the controller. The controller may be operable to operate the alerting device to provide an alert when a sensor of the plurality of provides an indication to the controller that the sensor detected an extension member transitioning from one cell to another.

In some embodiments each cover member may include a feature configured to facilitate transition of the cover including the cover member. The feature may be configured to facilitate transition of the cover including the cover member in an intended direction.

Further embodiments of the invention are directed to a medication dispensing apparatus including a housing including a plurality of inner walls, the plurality of inner walls defining a plurality of cells. The apparatus may also include a plurality of covers, each cover including a cover member and an extension member extending downwards from the cover member. The apparatus may also include a frame configured to be attached to the housing and to prevent detachment of the covers from the apparatus. The apparatus may also include a controller, a plurality of sensors positioned in communication with the controller operable to detect when an extension member transitions from one cell to another, and an alerting device positioned in communication with the controller. The controller may be operable to operate the alerting device to provide an alert when a sensor of the plurality of provides an indication to the controller that the sensor detected an extension member transitioning from one cell to another. Each cell of the plurality of cells may be operable to permit medication to be positioned there within. The plurality of inner walls may be configured to interface with and suspend the cover members of the plurality of covers, such that each cover may prevent access to a cell of the plurality of cells. The covers of the plurality of covers may be configured to prevent two covers of the plurality of covers from being positioned so as to simultaneously prevent access to a single cell of the plurality of cells. Additionally, the plurality of inner walls may be configured to permit each cover of the plurality of covers to transition exclusively between two cells of the plurality of cells. Furthermore, the extension members may be operable to interface with an object positioned within the plurality of cells, such that the presence of an object within an instant cell prevents the transition of a cover of the plurality of covers from an adjacent cell to the instant cell and the absence of an object within the instant cell enables the transition of a cover of the plurality of covers from an adjacent cell to the instant cell, thereby providing access to the adjacent cell.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
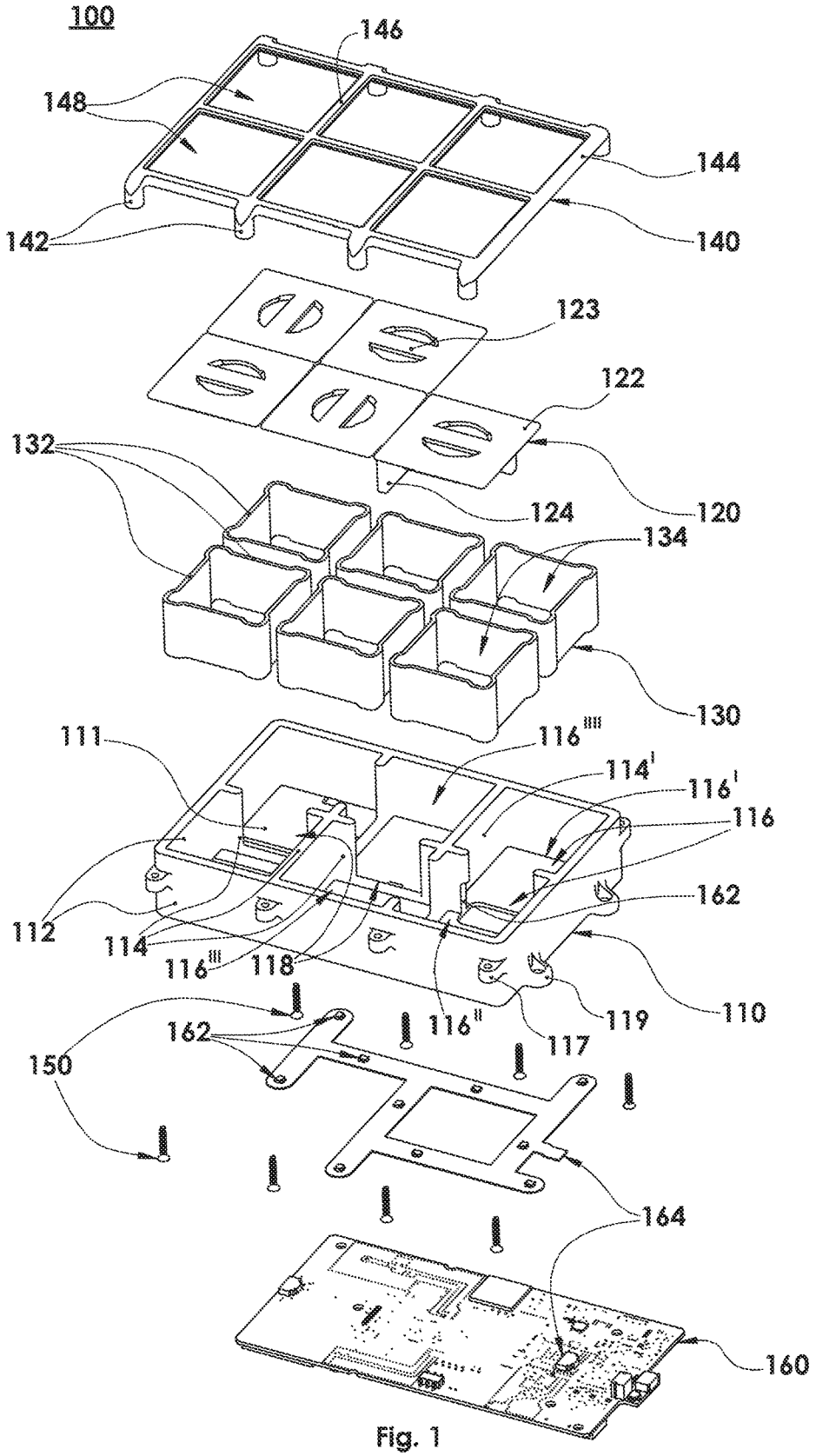
FIG. 1 is a perspective exploded view of an apparatus for sequential dispensing of objects according to an embodiment of the present invention.
Figure 2:
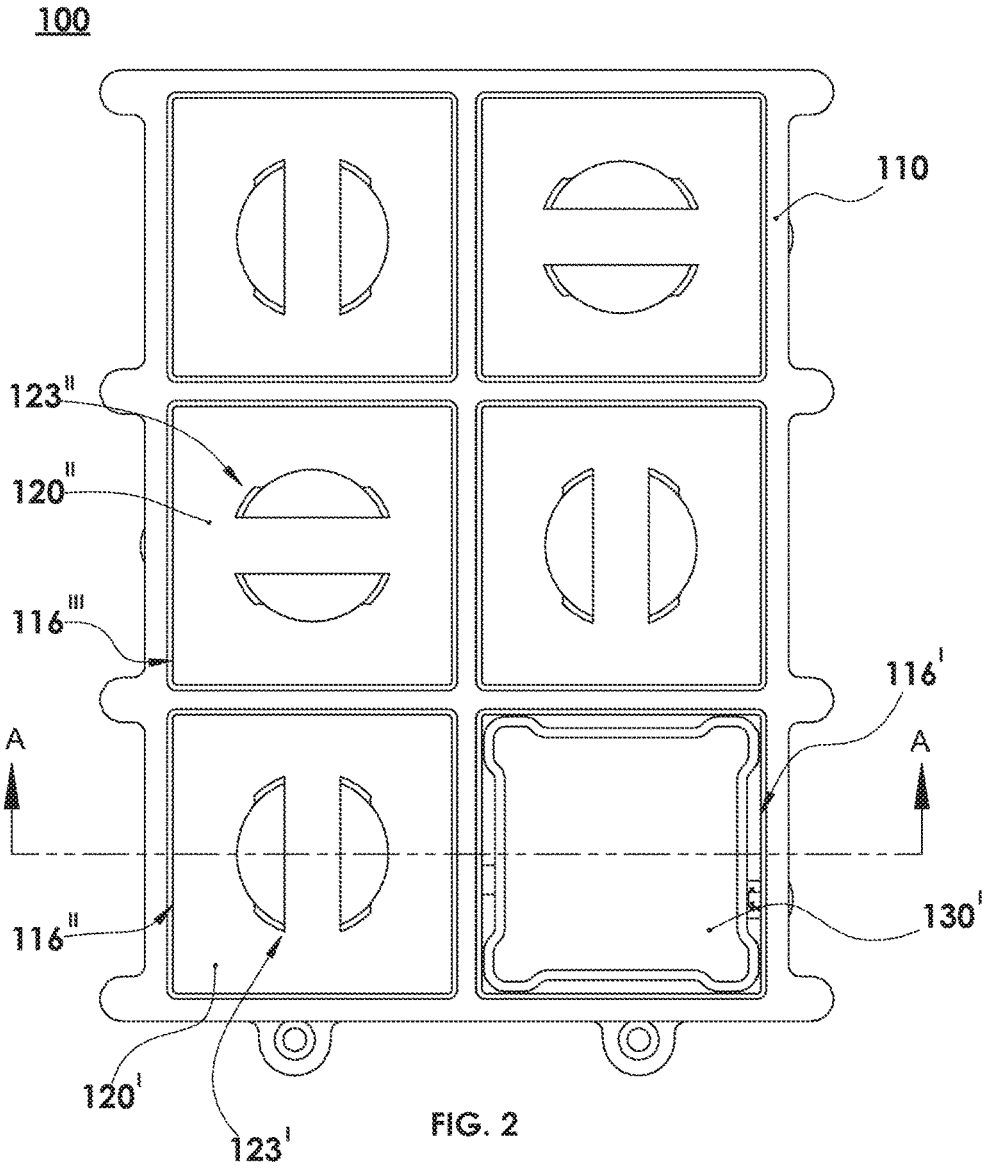
FIG. 2 is a top view of the apparatus of FIG. 1
Figure 3:
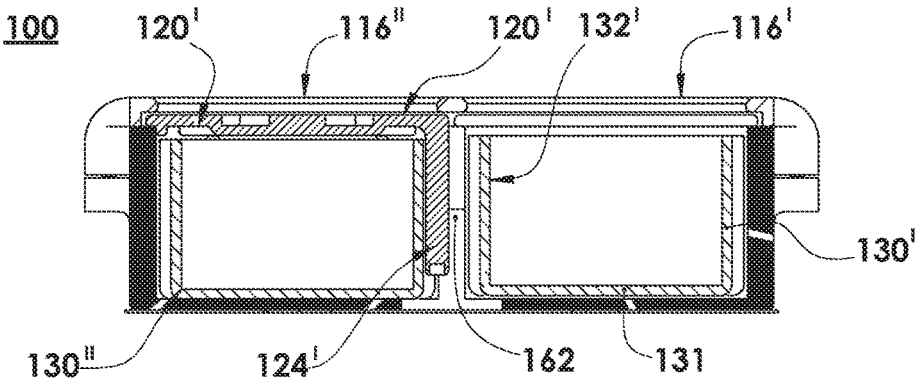
FIG. 3 is a side sectional view of the apparatus of FIG. 1 taken through line A-A of FIG. 2.

Referring now to FIGS. 1-3, an apparatus 100 for the sequential dispensing of objects is presented. "Dispensing" may be understood to include making an object available for a user to retrieve by removing impediments to such retrieval put in place by the apparatus. The apparatus 100 may include a housing 110 and a plurality of covers 120. The housing 110 may comprise a base 111, a plurality of outer walls 112, and a plurality of inner walls 114. The plurality of outer walls 112 may interface with and/or attach to the base 111, thereby defining an interior volume of the housing 110. In some embodiments, the base 111 and the plurality of outer walls may be integrally formed, e.g. be formed as a single integral body. In other embodiments, the plurality of outer walls 112 may be attached to the base 111 by any means or method known in the art, including, but not limited to, welding, gluing, use of adhesives, fastened by screw, nail, snap-tab, or the like, and forming an interference fit. The plurality of outer walls 112 may cooperate to define an outer shape of the housing 110. In the present embodiment, the plurality of outer walls 112 define a generally rectangular shape, however all geometries, including all polygonal shapes including square, circular, ovular, triangular, and the like, are contemplated and included within the scope of the invention.

The plurality of inner walls 114 may be positioned generally within a boundary defined by the plurality of outer walls 112. In some embodiments, some or all of the plurality of inner walls 114 may interface with and/or be attached to a wall of the plurality of outer walls 112. Additionally, in some embodiments, the plurality of inner walls 114 may be attached to and/or integrally formed with the base 111, thereby providing structural stability to the plurality of inner walls 114. The plurality of inner walls 114 may define a plurality of cells 116 there between. Each cell of the plurality of cells 116 may be understood as a space within which an object may be positioned. In some embodiments, medication may be positioned there within. Furthermore, in some embodiments, at least one of a wall of the plurality of outer walls 112 and the base 111 may cooperated with one or more walls of the plurality of inner walls 114 in defining a cell of the plurality of cells 116. The plurality of inner walls 114 may be configured to inhibit the transitioning of an object from one cell to an adjacent cell.

The plurality of inner walls 114 may be configured to interface with and suspend each cover of the plurality of covers 120. Furthermore, when the plurality of covers 120 are positioned on the plurality of inner walls 114, each cover of the plurality of covers may at least partially prevent access to a cell of the plurality of cells 116. Accordingly, an object positioned within a cell of the plurality of cells 116 may be generally rendered inaccessible to a person attempting to retrieve the object when a cover of the plurality of covers 120 is positioned so as to cover the cell of the plurality of cells 116 containing the object.

The plurality of inner walls 114 may further be configured to facilitate the transition of covers of the plurality of covers 120 between cells of the plurality of cells 116. At least a portion of the walls of the plurality of inner walls 114 may be configured to interface with the plurality of covers 120 so as to permit the plurality of covers 120 to translate horizontally (either longitudinally or latitudinally), thereby changing which cell of the plurality of cells 116 an instant cover of the plurality of covers 120 covers. More specifically, the plurality of inner walls 114 may be configured to facilitate a first cover 120' of the plurality of covers 120 to transition between covering a second cell 116" of the plurality of cells 116 and a first cell 116', adjacent the second cell 116", of the plurality of cells 116, thereby enabling access to the first cell. Similarly, the plurality of inner walls 114 may be configured to facilitate a second cover 120" of the plurality of covers 120 to transition between covering a third cell 116'" of the plurality of cells 116, adjacent the second cell 116", and the second cell 116", thereby enabling access to the third cell 116'". The presence of the first cover 120' in the second cell 116" may generally prevent the second cover 120" from transitioning to cover the second cell 116" prior to the first cover 120' transitioning to the first cell 116'. Generally speaking, when a cover is occupying and covering an instant cell, no other cover of the plurality of covers 120 may transition into and simultaneously cover the same instant cell.

In order to ensure that there will always be one cell of the plurality of cells 116 that is uncovered, thereby permitting a cover of the plurality of covers 120 to have a vacant cell to transition to, the plurality of covers 120 may comprise one fewer cover in number than the number of cells comprised by the plurality of cells 116. In the present embodiment, the plurality of covers 120 comprises five covers, and the plurality of cells 116 comprises six cells. However, these numbers are exemplary only, and any number of covers and cells are contemplated and included within the scope of the invention.

Each cover of the plurality of covers 120 may comprise a cover member 122 and an extending member 124. The extending member 124 may extend from a lower surface of the cover member 122. The cover member 122 may be configured to be dimensioned such that, when the cover is positioned over a cell, the cover member 122 may prevent access to the cell.

The cover member 122 may further comprise a feature 123. The feature 123 may be configured to facilitate the transition of the cover comprising cover member 122. More specifically, the feature 123 may facilitate a user interfacing with the cover member 122 so as to actuate its transition between cells. In some embodiments, the feature may be configured to facilitate a user's use of an implement, such as a finger, to push, pull, or otherwise apply force to the cover member 122, thereby causing the cover to slide between adjacent cells. In some embodiments, the feature 123 may be configured to facilitate transition of the cover comprising the cover member 122 in an intended direction. In some embodiments, the feature 123 may be configured to convey a visual indication as to an intended direction of transition for the cover comprising the cover member 122. For example, the first cover 120' may comprise a feature 123' configured to indicate a first direction of transition, i.e. between the first and second cells 116', 116", and the second cover 120" may comprise a feature 123" configured to indicate a second direction of transition, i.e. between the second and third cells 116", 116'".

The plurality of inner walls 114 may be configured to permit each cover of the plurality of covers 120 to transition exclusively between two cells of the plurality of cells. More specifically, the plurality of inner walls 114 may be configured to permit each cover of the plurality of covers 120 to transition exclusively between two cells of the plurality of cells 116 based upon the orientation of cover. The plurality of inner walls 114 may define a plurality of inner wall apertures 118. The plurality of inner wall apertures 118 may be positioned between two adjacent cells of the plurality of cells 116. The plurality of inner wall apertures 118 may be configured to permit an extending 35 of a cover to pass therethrough when transitioning between adjacent cells. Accordingly, the plurality of inner walls 114 may interface with and suspend the plurality of covers 120 such that they may transition between adjacent cells of the plurality of cells 116 with their extending members 124 passing through the plurality of inner wall apertures 118. The portion of the plurality of inner walls, surrounding and generally defining the plurality of inner wall apertures 118 may contribute to the prevention of objects placed within the plurality of cells 116 from transitioning between adjacent cells.

Additionally, the plurality of inner walls 114 may be configured to prevent the transitioning of covers between some adjacent cells. For example, an inner wall 114' of the plurality of inner walls 114 positioned between the first cell 116' and a fourth cell 116"" of the plurality of cells 116 may be configured to interfere with extending members 124 of covers of the plurality of covers 120 positioned in either the first or fourth cells 116', 116"", thereby preventing the transition of covers there between.

The apparatus 100 may further comprise a plurality of inserts 130. Each insert of the plurality of inserts 130 may be configured to permit an object to be positioned there within. More specifically, each insert of the plurality of inserts 130 may comprise a base 131 and a plurality of sidewalls 132. The plurality of sidewalls 132 may define an aperture 134 through which objects may be inserted into and removed from the plurality of inserts 130.

Each cell of the plurality of cells 116 may be configured to permit an insert of the plurality of inserts 130 to be positioned there within. For example, the first cell 116' has a first insert 130' positioned there within. The plurality of inner walls 114 may be configured to permit the plurality of inserts 130 to be positioned within the plurality of cells 116. Additionally, the plurality of inner walls 114 may also be configured to permit removal of the plurality of inserts 130 from the plurality of cells 116. Furthermore, the plurality of inner walls 114 may be configured to prevent inserts of the plurality of inserts 130 from transitioning between adjacent cells of the plurality of cells 116. For example, as can be seen in FIG. 3, the first insert 130' may be prevented from transitioning from the first cell 116' to the second cell 116" by a portion of the plurality of inner walls 114.

The plurality of covers 120 may be configured such that, when an insert of the plurality of inserts 130 is positioned within a cell adjacent to a cell that a cover of the plurality of covers is positioned over, the insert may prevent the cell from transitioning to the cell occupied by the insert. Furthermore, removal of the insert may allow the cover to transition to the cell previously occupied by the insert. For example, as seen in FIG. 3, the first insert 130' is positioned within the first cell 116' and the first cover 120' is positioned so as to cover the second cell 116". The extending member 124' of the first cover 120' may be positioned such that it interfaces with a sidewall 132' of the first insert 130' when transitioning the first cover 120' to the first cell 116' is attempted. Accordingly, when the first insert 130' is removed, the first cover 120' may transition from the second cell 116" to the first cell 116', thereby uncovering and permitting access to a second insert 130" positioned within the second cell 116".

The apparatus 100 may further comprise a frame 140. The frame may be configured to be attached to the housing 110. Furthermore, the frame 140 may be configured to prevent detachment and/or removal of the plurality of covers 120 from the apparatus 100. The frame 140 may comprise a plurality of attachment sections 142, an outer frame member 144, and an inner frame member 146. The plurality of attachment sections 142 may be attached at different positions on the outer frame member 144 and be configured to facilitate the attachment of the frame 140 to the housing 110. In the present embodiment, the housing 110 may comprise a plurality of frame attachment members 117 configured to correspond to each attachment member of the plurality of attachment sections 142 of the frame 140.

The plurality of attachment sections may be configured to cooperate with the plurality of frame attachment members 117 to removably attach the frame 140 to the housing 110. In the present embodiment, each of the plurality of frame attachment members 117 and the plurality of attachment sections 142 may be configured to receive a fastener in the form of a screw 150, the screw being operable to engage with each of a frame attachment member and an attachment section positioned adjacent to one another, thereby attaching them. There may be a screw 150 for each frame attachment member-attachment section pair. The use of such fasteners is exemplary only and all means and methods of attachment known in the art are contemplated and included within the scope of the invention, including, but not limited to, hooks, hook-and-loop, magnets, latches, and the like.

The outer frame member 144 may be configured to define a perimeter of the frame 140, and the inner frame member 146, in cooperated with the perimeter defined by the outer frame member 144, may be configured to define a plurality of frame apertures 148 of the frame 140. The plurality of frame apertures 148 may be configured to permit access to the plurality of cells 116 there through, such that a person may be able to reach through the plurality of frame apertures 148 and remove the contents of the plurality of cells 116. Moreover, the frame 140 may be configured to facilitate the translation of the plurality of covers 120 among the plurality of cells 116 by permitting a person to manipulate the plurality of covers 120 through the plurality of frame apertures 148. However, one or both of the outer frame member 144 and the inner frame member may be configured such that, when the apparatus is oriented so that the base 111 of the housing is facing upwards, the plurality of covers 120 may be retained and prevented from falling out of the apparatus 100 by the frame 140. Accordingly, at least one of a length and a width of the plurality of frame apertures 148 may be less than at least one of a length and a width of each cover of the plurality of covers 120.

In some embodiments, the housing 110 may further comprise housing attachment members 119. The housing attachment members 119 may be operable to attach the housing 110 to an external structure, as will be discussed in greater detail hereinbelow. The housing attachment members 119 may be configured to be attached to an external structure by any means or method as discussed hereinabove.

The apparatus 100 may further comprise a controller 160, a plurality of sensors 162, and an alerting device 164. The plurality of sensors 162 may be positioned in communication with the controller and be operable to detect when a cover of the plurality of covers 120 has transitioned between cells. More specifically, the plurality of sensors 162 may be operable to detect when an extension member transitions across a detection range of a sensor of the plurality of sensors 162. Upon such a transition, the plurality of sensors 162 may be operable to send to the controller 160 an indication of the transition. In some embodiments, the controller 160 may be configured to associate each sensor of the plurality of sensors 162 with a pair of adjacent cells of the plurality of cells 116, such that the controller 160 may be operable to identify which cells the transitioning cover has transitioned between. Additionally, the controller 160 may be operable to operate the alerting device 164 responsive to receiving an indication from the plurality of sensors that a cover has transitioned between cells. The plurality of sensors 162 may comprise any type of sensor operable to sense the described transition, including, but not limited to, optical sensors, magnetic sensors, proximity sensors, acoustic sensors, and the like.

The alerting device 164 may be operable to provide an indication to a person alerting them to the transition. Types of alerting devices include, but are not limited to, devices operable to emit light (including displays), devices operable to emit sound, and communication devices operable to send an electronic message to a remote computerized device, such as a text message, email, push notification, and the like.

Figure 4:
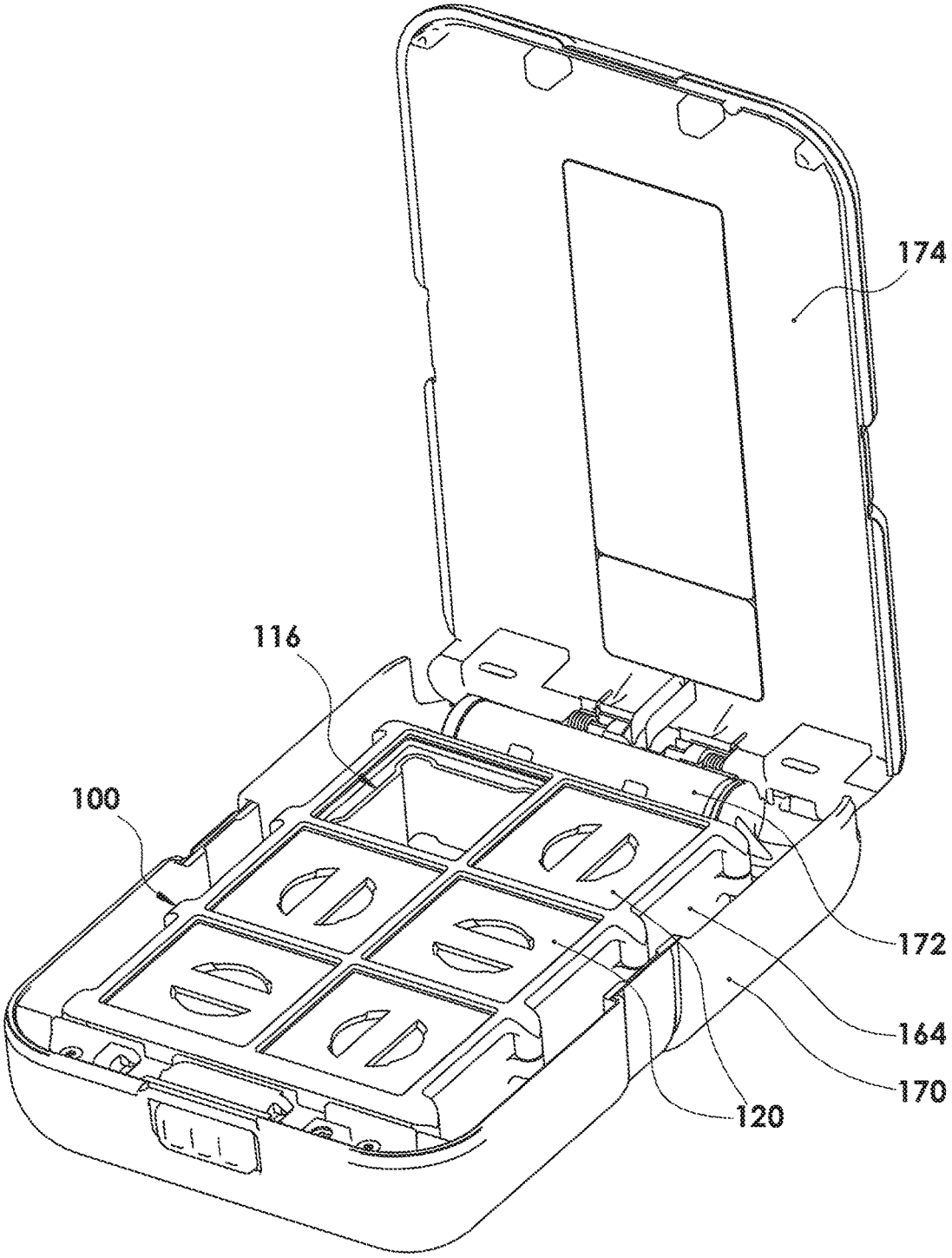
FIG. 4 is a perspective view of the apparatus of FIG. 1 situated within an external container.

Referring now to FIG. 4, the apparatus 100 according to FIGS. 1-3 is shown positioned within and attached to an external structure 170. The apparatus 100 may be attached to the external structure 170 via attachment of the housing attachment members 119 as describer hereinabove. The external structure 170 may comprise a power source 172, in the present embodiment a battery. The power source may be connected to and operable to provide power to the various electrical components of the apparatus 100, such as the controller 160, the plurality of sensors 162, and the alerting device 164. Furthermore, the apparatus 100 may be configured to be positioned within the external structure 170 such that a lid 174 of the external structure 170 may be positioned in a closed orientation, thereby enclosing the apparatus 100 within the external structure 170. When the lid 174 is positioned in an open orientation, as shown in FIG. 4, the plurality of covers 120 may be transitionable as described hereinabove to enable access to the plurality of cells 116.

Figure 5:
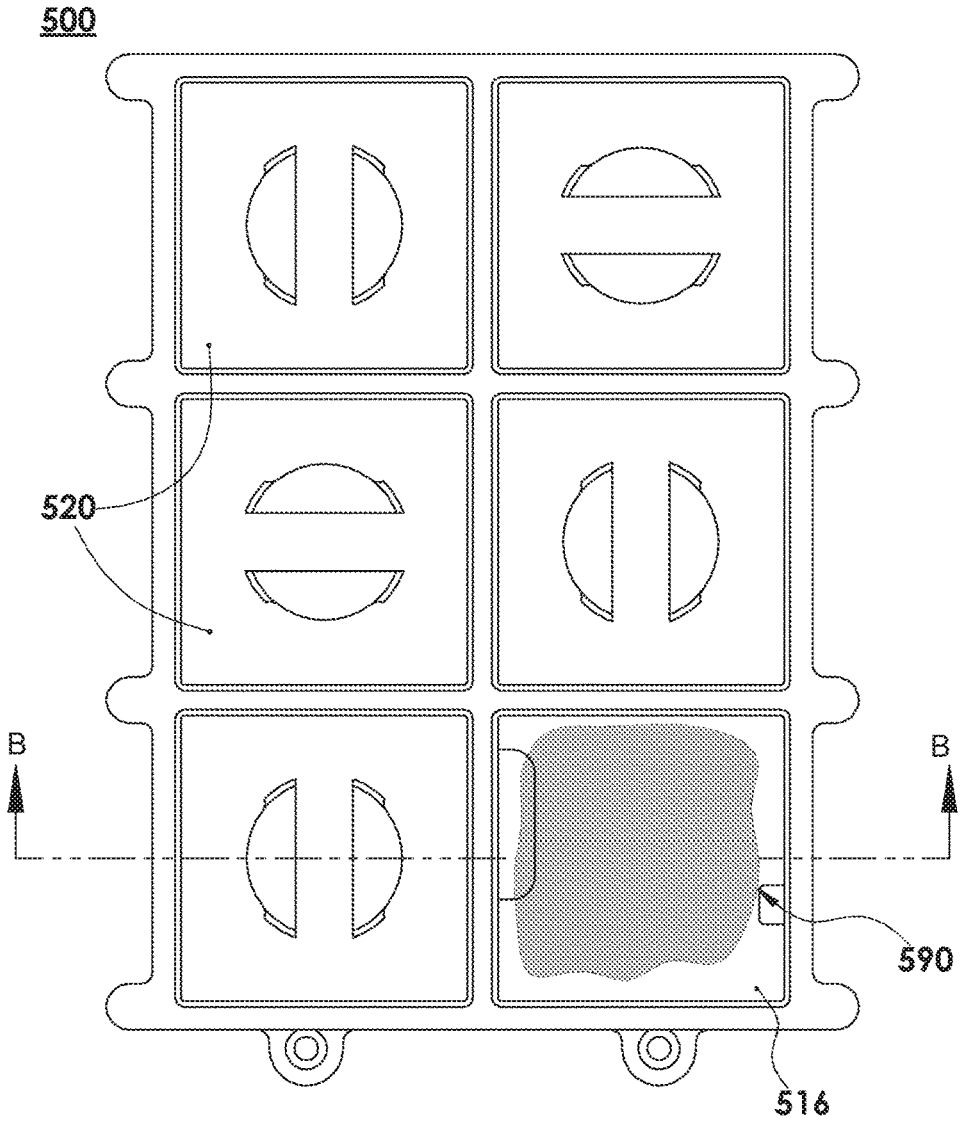
FIG. 5 is a top view of an apparatus for sequential dispensing of objects according to an embodiment of the present invention.
Figure 6:
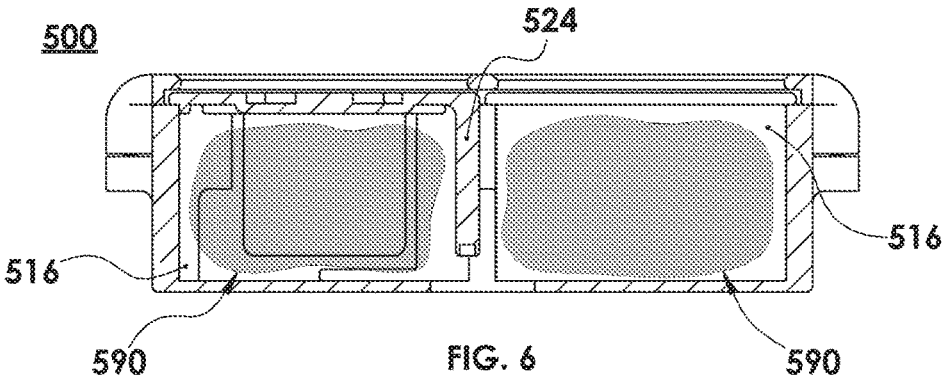
FIG. 6 is a side sectional view of the apparatus of FIG. 5 taken through line B-B of FIG. 5.

Referring now to FIGS. 5-6, an apparatus 500 according to an embodiment of the invention is presented. The apparatus 500 may be substantially similar to the apparatus 100 shown in FIGS. 1-3, with the exception that the apparatus 500 does not comprise a plurality of inserts. Instead, objects 590 positioned within a plurality of cavities 516 of the apparatus 500 may interface with and prevent the transition of a plurality of covers 520. More specifically, the objects 590 may interface with an extension member 524 of the plurality of covers 520 to thereby prevent the cover 520 from transitioning from an adjacent cell. Removal of an object 590 from an instant cell may permit the transitioning of a cover of the plurality of covers 520 from an adjacent cell to the instant cell, thereby enabling access to the adjacent cell and any object 590 positioned there within.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A dispensing apparatus comprising:

a housing comprising a plurality of inner walls, the plurality of inner walls defining a plurality of cells; and a plurality of covers, each cover comprising a cover member and an extension member extending downwards from the cover member;

wherein each cell of the plurality of cells is operable to permit an object to be positioned there within;

wherein the plurality of inner walls is configured to interface with and suspend the cover members of the plurality of covers, such that each cover may prevent access to a cell of the plurality of cells;

wherein the plurality of inner walls is configured to facilitate the transitioning of the plurality of covers from an instant cell to an adjacent cell of the plurality of cells in one direction and to prevent transition to an adjacent cell in another direction;

wherein the covers of the plurality of covers are configured to prevent two covers of the plurality of covers from being positioned so as to simultaneously prevent access to a single cell of the plurality of cells; and wherein the extension members are operable to interface with an object positioned within the plurality of cells, such that the presence of an object within an instant cell prevents the transition of a cover of the plurality of covers from an adjacent cell to the instant cell and the absence of an object within the instant cell enables the transition of a cover of the plurality of covers from an adjacent cell to the instant cell, thereby providing access to the adjacent cell.

2. The apparatus of claim 1 wherein the plurality of covers comprises a number of covers that is one fewer than the number of cells comprised by the plurality of cells.

3. The apparatus of claim 1 wherein the plurality of inner walls is configured to permit each cover of the plurality of covers to transition exclusively between two cells of the plurality of cells.

4. The apparatus of claim 3 wherein:

the plurality of inner walls is configured to permit a first cover of the plurality of covers to transition exclusively between first and second cells of the plurality of cells; and the plurality of inner walls is configured to permit a second cover of the plurality of covers to transition exclusively between second and third cells of the plurality of cells; and the second cover can transition from the third cell to the second cell only when the first cover is positioned at the first cell.

5. The apparatus of claim 1 further comprising a frame configured to be attached to the housing and to prevent detachment of the covers from the apparatus.

6. The apparatus of claim 5 wherein the frame defines a plurality of frame apertures; and wherein the plurality of cells is accessible through the plurality of frame apertures.

7. The apparatus of claim 1 wherein each extending member of the plurality of covers is configured to interface with an object positioned within an instant cell of the plurality of cells thereby preventing the transitioning of a cover from an adjacent cell to the instant cell.

8. The apparatus of claim 7 wherein the plurality of inner walls is configured to inhibit the transitioning of an object from one cell to an adjacent cell.

9. The apparatus of claim 8 wherein the plurality of inner walls defines a plurality of inner wall apertures configured to facilitate the positioning there within and transition there through of extension members of the plurality of covers; and wherein the positioning of an extension member within a wall aperture prevents the transitioning of objects between adjacent cells.

10. The apparatus of claim 1 further comprising a plurality of inserts configured to permit objects to be positioned there within; wherein the plurality of inner walls are configured to permit an insert of the plurality of inserts within each cell of the plurality of cells; wherein each insert of the plurality of inserts is configured to be removed from the plurality of cells; and wherein the extension member of each cover of the plurality of covers is configured to interface with an insert positioned within a cell, thereby preventing the transition of a cover of the plurality of covers from an adjacent cell to an instant cell containing an insert.

11. The apparatus of claim 10 wherein the plurality of inner walls is configured to prevent inserts from transitioning between adjacent cells.

12. The apparatus of claim 1 further comprising:

a controller;

a plurality of sensors positioned in communication with the controller operable to detect when an extension member transitions from one cell to another; and an alerting device positioned in communication with the controller;

wherein the controller is operable to operate the alerting device to provide an alert when a sensor of the plurality of provides an indication to the controller that the sensor detected an extension member transitioning from one cell to another.

13. The apparatus of claim 1 wherein each cover member comprises a feature configured to facilitate transition of the cover comprising the cover member.

14. The apparatus of claim 13 wherein the feature is configured to facilitate transition of the cover comprising the cover member in an intended direction.

15. A dispensing apparatus comprising:

a housing comprising a plurality of inner walls, the plurality of inner walls defining a plurality of cells;

a plurality of covers, each cover comprising a cover member and an extension member extending downwards from the cover member; and a frame configured to be attached to the housing and to prevent detachment of the covers from the apparatus, the frame defining a plurality of frame apertures through which the plurality of cells may be accessed;

wherein each cell of the plurality of cells is operable to permit objects to be positioned there within;

wherein the plurality of inner walls is configured to interface with and suspend the cover members of the plurality of covers, such that each cover may prevent access to a cell of the plurality of cells;

wherein the plurality of inner walls is configured to permit each cover of the plurality of covers to transition exclusively between two cells of the plurality of cells;

wherein the covers of the plurality of covers are configured to prevent two covers of the plurality of covers from being positioned so as to simultaneously prevent access to a single cell of the plurality of cells; and wherein the extension members are operable to interface with an object positioned within the plurality of cells, such that the presence of an object within an instant cell prevents the transition of a cover of the plurality of covers from an adjacent cell to the instant cell and the absence of an object within the instant cell enables the transition of a cover of the plurality of covers from an adjacent cell to the instant cell, thereby providing access to the adjacent cell.

16. The apparatus of claim 15 wherein each extending member of the plurality of covers is configured to interface with objects positioned within an instant cell of the plurality of cells thereby preventing the transitioning of a cover from an adjacent cell to the instant cell.

17. The apparatus of claim 15 further comprising a plurality of inserts configured to permit objects to be positioned there within; wherein the plurality of inner walls are configured to permit an insert of the plurality of inserts within each cell of the plurality of cells; wherein each insert of the plurality of inserts is configured to be removed from the plurality of cells; and wherein the extension member of each cover of the plurality of covers is configured to interface an insert positioned within a cell, thereby preventing the transition of a cover of the plurality of covers from an adjacent cell to an instant cell containing an insert.

18. The apparatus of claim 15 wherein each cover member comprises a feature configured to facilitate transition of the cover comprising the cover member in an intended direction.

19. The apparatus of claim 15 further comprising:

a controller;

a plurality of sensors positioned in communication with the controller operable to detect when an extension member transitions from one cell to another; and an alerting device positioned in communication with the controller;

wherein the controller is operable to operate the alerting device to provide an alert when a sensor of the plurality of provides an indication to the controller that the sensor detected an extension member transitioning from one cell to another.

20. A medication dispensing apparatus comprising:

a housing comprising a plurality of inner walls, the plurality of inner walls defining a plurality of cells;

a plurality of covers, each cover comprising a cover member and an extension member extending downwards from the cover member;

a frame configured to be attached to the housing and to prevent detachment of the covers from the apparatus;

a controller;

a plurality of sensors positioned in communication with the controller operable to detect when an extension member transitions from one cell to another; and an alerting device positioned in communication with the controller;

wherein the controller is operable to operate the alerting device to provide an alert when a sensor of the plurality of provides an indication to the controller that the sensor detected an extension member transitioning from one cell to another wherein each cell of the plurality of cells is operable to permit medication to be positioned there within;

wherein the plurality of inner walls is configured to interface with and suspend the cover members of the plurality of covers, such that each cover may prevent access to a cell of the plurality of cells;

wherein the covers of the plurality of covers are configured to prevent two covers of the plurality of covers from being positioned so as to simultaneously prevent access to a single cell of the plurality of cells;

wherein the plurality of inner walls is configured to permit each cover of the plurality of covers to transition exclusively between two cells of the plurality of cells; and wherein the extension members are operable to interface with an object positioned within the plurality of cells, such that the presence of an object within an instant cell prevents the transition of a cover of the plurality of covers from an adjacent cell to the instant cell and the absence of an object within the instant cell enables the transition of a cover of the plurality of covers from an adjacent cell to the instant cell, thereby providing access to the adjacent cell.

* * * * *